US005987641A

United States Patent [19]

Walker

[11] Patent Number: 5,987,641

[45] Date of Patent: Nov. 23, 1999

[54] WRIST GUARDS

[76] Inventor: William W. Walker, P.O. Box 925213, Houston, Tex. 77292

[21] Appl. No.: 09/018,977

[22] Filed: Feb. 5, 1998

[51] Int. Cl.[6] ..... A41D 13/08

[52] U.S. Cl. ..... 2/16; 2/161.1; 2/162; 602/21; 128/879

[58] Field of Search ..... 2/16, 20, 160, 2/161.1, 162; 602/21, 6, 7, 64; 128/878, 879

[56] References Cited

U.S. PATENT DOCUMENTS

| | | | |
|---|---|---|---|
| 2,800,129 | 7/1957 | Swaay | 128/90 |
| 3,790,168 | 2/1974 | Hashimoto | 273/54 B |
| 4,374,439 | 2/1983 | Norman | 2/161.1 |
| 4,854,309 | 8/1989 | Elsey | 128/87 R |
| 4,925,187 | 5/1990 | Fleenor et al. | 273/54 B |
| 5,307,521 | 5/1994 | Davis | 2/22 |
| 5,313,667 | 5/1994 | Levine | 2/16 |
| 5,339,465 | 8/1994 | Kyewski | 2/20 |
| 5,566,389 | 10/1996 | Li | 2/16 |
| 5,652,955 | 8/1997 | Skewis | 2/20 |
| 5,722,092 | 3/1998 | Borzecki et al. | 2/16 |
| 5,733,249 | 3/1998 | Katzin et al. | 602/21 |
| 5,819,313 | 10/1998 | McCrane | 2/16 |

*Primary Examiner*—John J. Calvert
*Assistant Examiner*—Tejash Patel

[57] ABSTRACT

A wrist pad is provided including a flexible removable wrap with a top extent and a bottom extent. At least one sleeve is mounted on the bottom extent of the wrap. A rigid element includes at least one portion defining a periphery of a cylinder and a sphere. Such rigid element is removably situated within the sleeve during use.

9 Claims, 2 Drawing Sheets

WRIST GUARDS

RELATED DATA

The subject matter of the present utility patent application has been registered with the United States Patent and Trademark Office under the disclosure document program. The request was received in the U.S.P.T.O. on Jul. 14, 1995 and was assigned the registration number 378643.

BACKGROUND OF THE INVENTION

1. Field of the Invention

The present invention relates to wrist pads and more particularly pertains to a new wrist guards for providing superior protection to a wrist of a user during activities such as skating and skateboarding.

2. Description of the Prior Art

The use of wrist pads is known in the prior art. More specifically, wrist pads heretofore devised and utilized are known to consist basically of familiar, expected and obvious structural configurations, notwithstanding the myriad of designs encompassed by the crowded prior art which have been developed for the fulfillment of countless objectives and requirements.

Known prior art wrist pads include U.S. Pat. No. 5,329,638; U.S. Pat. No. 5,267,943; U.S. Pat. No. Des. 270,556; U.S. Pat. No. 5,313,667; U.S. Pat. No. 3,945,045; and U.S. Pat. No. 4,896,378.

In these respects, the wrist guards according to the present invention substantially departs from the conventional concepts and designs of the prior art, and in so doing provides an apparatus primarily developed for the purpose of providing superior protection to a wrist of a user during activities such as skating and skateboarding.

SUMMARY OF THE INVENTION

In view of the foregoing disadvantages inherent in the known types of wrist pads now present in the prior art, the present invention provides a new wrist guards construction wherein the same can be utilized for providing superior protection to a wrist of a user during activities such as skating and skateboarding.

The general purpose of the present invention, which will be described subsequently in greater detail, is to provide a new wrist guards apparatus and method which has many of the advantages of the wrist pads mentioned heretofore and many novel features that result in a new wrist guards which is not anticipated, rendered obvious, suggested, or even implied by any of the prior art wrist pads, either alone or in any combination thereof.

To attain this, the present invention generally comprises a flexible removable wrap having a top extent with a planar rectangular configuration. A periphery of the top extent is defined by a short linear front edge, a short linear rear edge and a pair of elongated linear side edges. For reasons that will become apparent hereinafter, the top extent has a first pile fastener mounted thereon. The wrap further includes a bottom extent having a periphery with a first elongated linear side edge integrally coupled to one of the those of the top extent. A second side edge of the periphery of the bottom extent has a rear portion in parallel with the first elongated linear side edge and a front portion angled toward the first elongated linear side edge and extending therepast. A front edge of the periphery is angled between the front portion of the second side edge and the first elongated linear side edge.

A short linear rear edge is situated in perpendicular relationship with the second side edge. A rectangular sleeve is mounted on the bottom extent of the wrap in spaced parallel relationship with the rear portion of the second side edge. As shown in FIG. 1, the rectangular sleeve is equipped with a length equal to the second side edge. The rectangular sleeve defines an open face and has a pair of rigid elongated loops mounted thereon. Such loops are preferably mounted along a long side edge of the rectangular sleeve adjacent to the second side edge of the bottom extent of the wrap. Associated therewith is a triangular sleeve mounted on the bottom extent. The triangular sleeve is equipped with a pair of front edges contiguously coupled along the front portion of the second side edge and the front edge of the bottom extent of the wrap. As shown in FIG. 1, the triangular sleeve has a trapezoidal cut out formed in a rear edge thereof. The triangular sleeve defines a rear opening in line with the open face of the rectangular sleeve. With reference still to FIG. 1, a pair of flexible inelastic rectangular fasteners each have a first end mounted to a rear extent of one of the elongated linear side edges of the top extent of the wrap. The pair of fasteners extend perpendicularly from the wrap in parallel relationship. It should be noted that a first surface of each fastener has a hook fastener positioned thereon and a second surface of each fastener has a loop fastener. During use, a second end of each fastener may be removably passed through the associated one of the elongated loops of the rectangular sleeve. Further, the hook and loop fasteners may be coupled to maintain the top extent of the wrap over a top of a user's wrist and the bottom extent of the wrap under a bottom of the user's wrist. As such, a front of a hand of the user extends from the wrap. A third flexible inelastic rectangular fastener is provided having a first end coupled to the front portion of the second side edge of the bottom extent in perpendicular relationship therewith. The third fastener further resides in alignment with the front edge of the bottom extent of the wrap. In use, the third flexible inelastic rectangular fastener has a second pile fastener for releasably securing with the first pile fastener of the top extent of the wrap. Finally, a rigid element is provided including an elongated rear portion which defines a portion of a periphery of a cylinder with an associated first axis. An intermediate portion of the rigid element also defines a portion of a periphery of a cylinder, but with an associated second axis. This second axis is angled downwardly with respect to the first axis, as shown in FIG. 4. A front portion of the rigid element extends upwardly from the intermediate extent and defines a portion of a periphery of a sphere. A peripheral edge of the rigid element has a pad situated thereon and extending outwardly therefrom. Before use of the present invention, the rear and intermediate portions of the rigid element may be removably situated within the rectangular sleeve and a part of the front portion may be removably positioned within the triangular sleeve. A ground engagement surface is provided by an exposed part of the front portion between the sleeves.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wrist guards apparatus and method which has many of the advantages of the wrist pads mentioned heretofore and many novel features that result in a new wrist guards which is not anticipated, rendered obvious, suggested, or even implied by any of the prior art wrist guards, either alone or in any combination thereof.

It is another object of the present invention to provide a new wrist guards which may be easily and efficiently manufactured and marketed.

It is a further object of the present invention to provide a new wrist guards which is of a durable and reliable construction.

An even further object of the present invention is to provide a new wrist guards which is susceptible of a low cost of manufacture with regard to both materials and labor, and which accordingly is then susceptible of low prices of sale to the consuming public, thereby making such wrist guards economically available to the buying public.

Still yet another object of the present invention is to provide a new wrist guards which provides in the apparatuses and methods of the prior art some of the advantages thereof, while simultaneously overcoming some of the disadvantages normally associated therewith.

Still another object of the present invention is to provide a new wrist guards for providing superior protection to a wrist of a user during activities such as skating and skateboarding.

Even still another object of the present invention is to provide a new wrist guards that includes a flexible removable wrap with a top extent and a bottom extent. At least one sleeve is mounted on the bottom extent of the wrap. A rigid element includes at least one portion defining a periphery of a cylinder and a sphere. Such rigid element is removably situated within the sleeve during use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
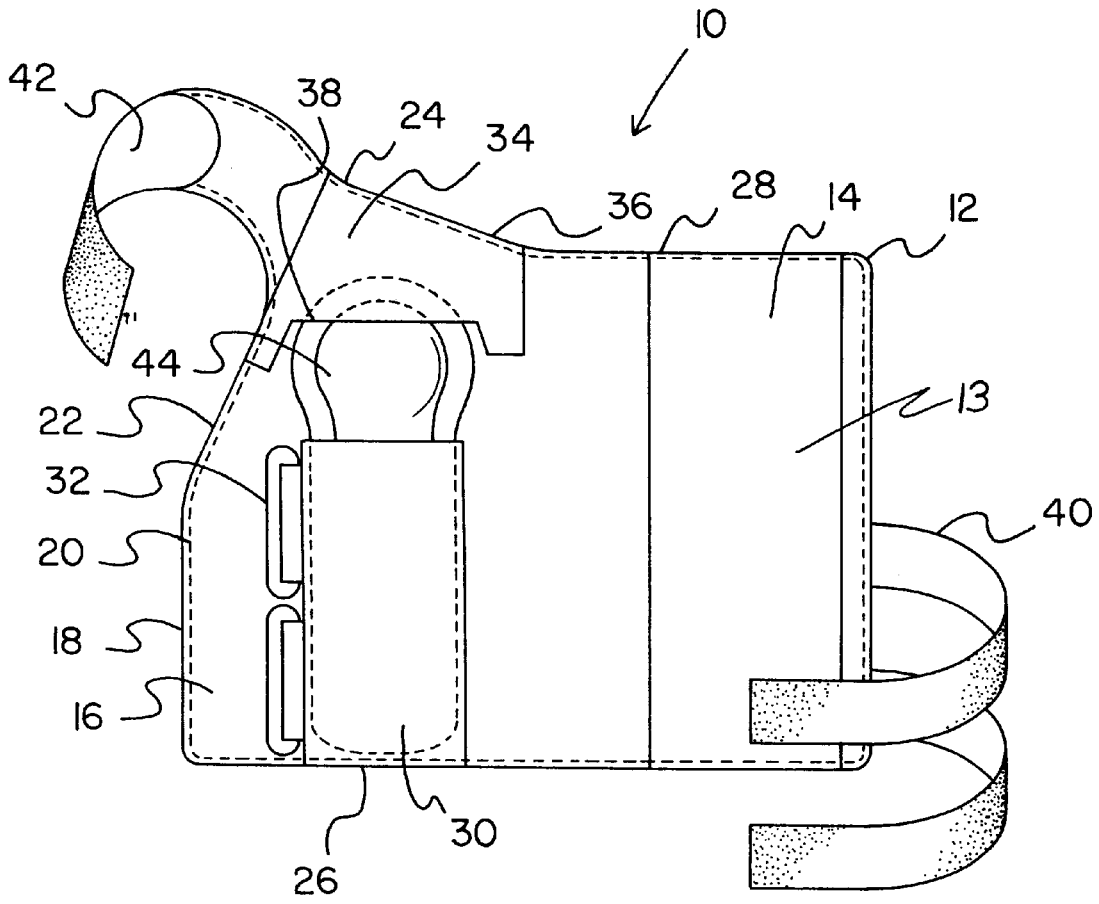
FIG. 1 is an illustration of a new wrist guard according to the present invention.
Figure 2:
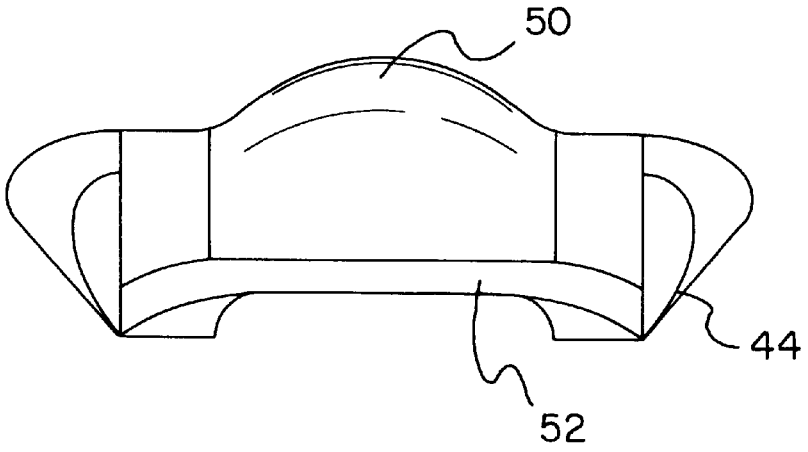
FIG. 2 is a rear view of the rigid element of the present invention.
Figure 3:
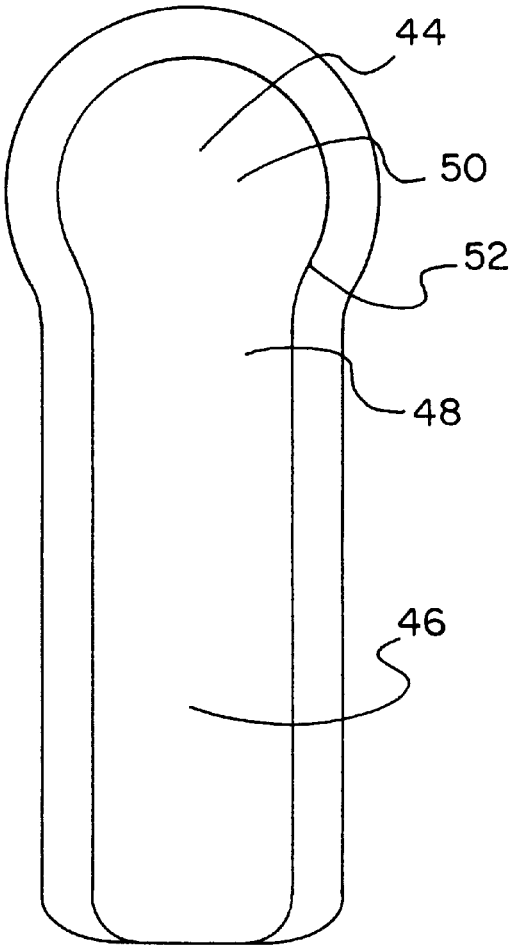
FIG. 3 is a bottom view of the rigid element of the present invention.

With reference now to the drawings, and in particular to FIGS. 1 through 4 thereof, a new wrist guards embodying the principles and concepts of the present invention and generally designated by the reference numeral 10 will be described.

The present invention, as designated as numeral 10, includes a flexible removable wrap 12 having a top extent 13 with a planar rectangular configuration for covering the top of a user's wrist. The top extent is defined by a short linear front edge, a short linear rear edge and a pair of elongated linear side edges. The front edge, the rear edge and the side edges are coupled such that a contiguous periphery is formed around the top extent. The side edges extending between the front edge and the rear edge. For reasons that will become apparent hereinafter, the top extent has a first pile fastener 14 mounted thereon.

The wrap further includes a bottom extent 16 having a periphery with a first elongated linear side edge integrally coupled to one of the those of the top extent. A second side edge 18 of the periphery of the bottom extent has a rear portion 20 in parallel with the first elongated linear side edge and a front portion 22 angled toward the first elongated linear side edge and extending therepast. A front edge 24 of the periphery is angled between the front portion of the second side edge and the first elongated linear side edge. A short linear rear edge 26 is situated in perpendicular relationship with the second side edge. In the preferred embodiment, an entire periphery of the top and bottom extents is equipped with a binding 28 for containing any padding lining the wrap.

A rectangular sleeve 30 is mounted on the bottom extent of the wrap in spaced parallel relationship with the rear portion of the second side edge. As shown in FIG. 1, the rectangular sleeve is equipped with a length equal to that of the second side edge. The rectangular sleeve defines an open face and has a pair of rigid elongated metal loops 32 mounted thereon by way of nylon loops. Such loops are preferably mounted along a long side edge of the rectangular sleeve adjacent to the second side edge of the bottom extent of the wrap.

Associated therewith is a triangular sleeve 34 mounted on the bottom extent. The triangular sleeve is equipped with a pair of front edges 36 contiguously coupled along the front portion of the second side edge and the front edge of the bottom extent of the wrap. As shown in FIG. 1, the triangular sleeve has a trapezoidal cut out 38 formed in a rear edge thereof. The triangular sleeve defines a rear opening in line with the open face of the rectangular sleeve.

With reference still to FIG. 1, a pair of flexible inelastic rectangular fasteners 40 each have a first end mounted to a rear extent of one of the elongated linear side edges of the top extent of the wrap. The pair of fasteners extend perpendicularly from the wrap in parallel relationship. It should be noted that a first surface of each fastener has a hook fastener positioned thereon and a second adjacent surface of each fastener has a loop fastener. During use, a second end of each fastener may be removably passed through the associated one of the elongated loops of the rectangular sleeve. Further, the hook and loop fasteners may be coupled to maintain the top extent of the wrap over a top of a user's wrist and the bottom extent of the wrap under a bottom of the user's wrist. As such, a hand of the user extends from a front of the wrap.

A third flexible inelastic rectangular fastener 42 is provided having a first end coupled to the front portion of the second side edge of the bottom extent in perpendicular relationship therewith. The third fastener further resides in alignment with the front edge of the bottom extent of the wrap. In use, the third flexible inelastic rectangular fastener has a second pile fastener for releasably securing with the first pile fastener of the top extent of the wrap. It should be noted that the various pile fasteners may be either hook or loop fasteners.

Figure 4:
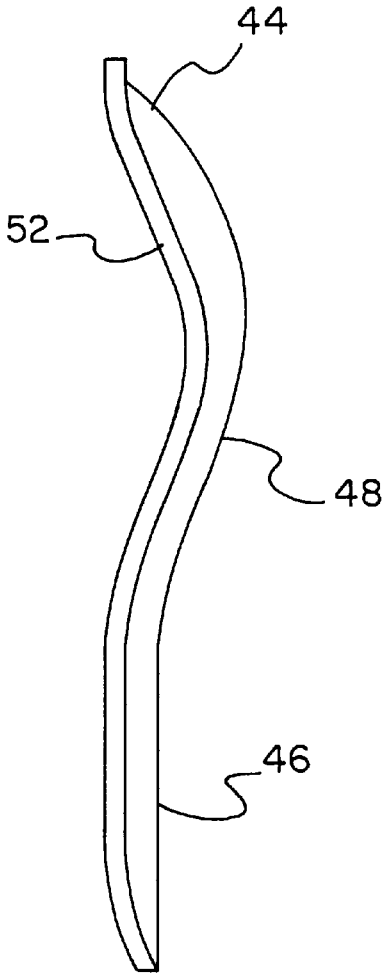
FIG. 4 is a side view of the rigid element of the present invention.

Finally, a rigid element 44 is provided including an elongated rear portion 46 which defines a portion of a periphery of a cylinder with an associated first axis. An intermediate portion 48 of the rigid element also defines a portion of a periphery of a cylinder, but with an associated second axis. This second axis is angled downwardly with respect to the first axis, as shown in FIG. 4. A front portion 50 of the rigid element extends upwardly from the intermediate extent and defines a portion of a periphery of a sphere.

A peripheral edge 52 of the rigid element has a pad situated thereon and extends outwardly therefrom. Before use of the present invention, the rear and intermediate portions of the rigid element may be removably situated within the rectangular sleeve and a part of the front portion may be removably positioned within the triangular sleeve. A ground engagement surface is provided by an exposed part of the front portion between the sleeves.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wrist pad for binding against a wrist area of the arm of a user's body, the wrist pad comprising:

a flexible removable wrap including a top extent with a planar rectangular configuration adapted for covering a top portion of a user's wrist, the top extent having a short linear front edge, a short linear rear edge and a pair of elongated linear side edges forming a contiguous periphery around the top extent, the top extent having a first pile fastener mounted thereon, the wrap further including a bottom extent adapted for covering a bottom portion and side portions of a user's wrist, the bottom extent including a periphery with a first elongated linear side edge integrally coupled to one of the side edges of the top extent, a second side edge having a rear portion in parallel with the first elongated linear side edge and a front portion angled toward the first elongated linear side edge, a front edge angled between the front portion of the second side edge and the first elongated linear side edge, and a short linear rear edge situated in perpendicular relationship with the second side edge;

a rectangular sleeve mounted on the bottom extent of the wrap in spaced parallel relationship with the rear portion of the second side edge and with a length equal thereto, wherein the rectangular sleeve defines an open face and has a pair of rigid elongated loops mounted along a long side edge of the sleeve adjacent to the second side edge of the bottom extent of the wrap;

a triangular sleeve mounted on the bottom extent with a pair of front edges contiguously coupled along the front portion of the second side edge and the front edge of the bottom extent of the wrap, the triangular sleeve having a trapezoidal cut out formed in a rear edge thereof thereby defining a rear opening in line with the open face of the rectangular sleeve;

a pair of flexible inelastic rectangular fasteners each having a first end mounted to a rear extent of one of the elongated linear side edges of the top extent of the wrap and extending perpendicularly therefrom in parallel relationship, a first surface of each fastener having a hook fastener positioned thereon and a second surface of each fastener having a loop fastener positioned thereon, whereby a second end of each fastener may be removably passed through the associated one of the elongated loops of the rectangular sleeve and the hook and loop fasteners coupled to maintain the top extent of the wrap over a top of a user's wrist and the bottom extent of the wrap under a bottom of the user's wrist such that a front of a hand of the user extends therefrom;

a third flexible inelastic rectangular fastener having a first end coupled to the front portion of the second side edge of the bottom extent in perpendicular relationship therewith and further in alignment with the front edge of the bottom extent of the wrap, the third flexible inelastic rectangular fastener having a second pile fastener mounted thereon for releasably securing with the first pile fastener of the top extent of the wrap during use; and a rigid element including an elongated rear portion which defines a portion of a periphery of a cylinder with an associated first axis, an intermediate portion which defines a portion of a periphery of a cylinder with an associated second axis which is angled downwardly with respect to the first axis, and a front portion extending upwardly from the intermediate extent and defining a portion of a periphery of a sphere, wherein a peripheral edge of the element has a pad situated thereon, whereby the rear and intermediate portions of the rigid element may be removably situated within the rectangular sleeve and a part of the front portion may be removably positioned within the triangular sleeve such that another part of the front portion is exposed between the sleeves.

2. A wrist pad for binding against a wrist area of the arm of a user's body, the wrist pad comprising:

a flexible removable wrap with a top extent adapted for covering a top of a user's wrist and a bottom extent adapted for covering a bottom and sides of a user's wrist;

the bottom extent of the wrap includes a periphery with a first and second side edge, the second side edge having a rear portion in parallel with a first elongated linear side edge and a front portion angled toward the first elongated linear side edge and extending therepast, the periphery further including a front edge angled between the front portion of the second side edge and the first side edge;

a flexible inelastic rectangular fastener has a first end coupled to the front portion of the second side edge of the bottom extent in perpendicular relationship therewith and further in alignment with the front edge of the bottom extent of the wrap, the third flexible inelastic rectangular fastener having a pile fastener mounted thereon for releasably securing with a pile fastener of the top extent of the wrap;

at least one sleeve mounted on the bottom extent of the wrap; and a rigid element including at least one portion defining a periphery of a cylinder, whereby the rigid element is removably situated within the sleeve.

3. A wrist pad as set forth in claim 2 wherein the rigid element further includes at least one portion defining a portion of a periphery of a sphere.

4. A wrist pad as set forth in claim 2 wherein a pair of sleeves are provided including a triangular sleeve and a rectangular sleeve.

5. A wrist pad as set forth in claim 2 wherein the wrap is equipped with at least one loop mounted adjacent the sleeve such that at least one fastener may be passed therethrough and secured in a closed loop by way of a securement means.

6. A wrist pad as set forth in claim 5 wherein the securement means includes a hook fastener on a first surface of the fastener and a loop fastener on a second surface of the fastener.

7. A wrist pad for binding against a wrist area of the arm of a user's body, the wrist pad comprising:

a flexible removable wrap with a top extent adapted for covering a top of a user's wrist and a bottom extent adapted for covering a bottom and sides of a user's wrist;

the bottom extent of the wrap includes a periphery with a first and second side edge, the second side edge having a rear portion in parallel with a first elongated linear side edge and a front portion angled toward the first elongated linear side edge and extending therepast, the periphery further including a front edge angled between the front portion of the second side edge and the first side edge;

a flexible inelastic rectangular fastener has a first end coupled to the front portion of the second side edge of the bottom extent in perpendicular relationship therewith and further in alignment with the front edge of the bottom extent of the wrap, the third flexible inelastic rectangular fastener having a pile fastener mounted thereon for releasably securing with a pile fastener of the top extent of the wrap;

at least one sleeve mounted on the bottom extent of the wrap; and a rigid element including at least one portion defining a periphery of a sphere.

8. A wrist protective member for binding against a wrist area of the arm of a user's body, the protective member comprising:

a generally elongate rigid element, the rigid element having a body side for situating toward the user's body and an outer side for situating away from the user's body, the rigid element having a longitudinal direction and a lateral direction oriented generally perpendicular to the longitudinal direction, the rigid element having a curvature in the lateral direction such that the body side has a concave curvature and the outer side has a convex curvature;

the rigid element including a rear end portion, a front end portion, and an intermediate portion located between the end portions, the rigid element has a peripheral edge wherein the protective member includes a peripheral edge pad mounted on the rigid member along the peripheral edge and extending outwardly from the peripheral edge;

the elongated rear end portion defining a portion of a periphery of a cylinder with an associated first axis, the intermediate portion defining a portion of a periphery of a cylinder with an associated second axis, the intermediate portion being coupled to the rear end portion, the second axis being angled in an outward direction with respect to the first axis of the rear end portion, and the front end portion being coupled to the intermediate portion opposite the rear end portion, the front end portion defining a portion of a periphery of a sphere.

9. The wrist protective member of claim 8 wherein the rigid element has a peripheral edge, and wherein the rear end portion and the intermediate portion of the rigid member are bounded by substantially straight and parallel side edge portions of the peripheral edge, and wherein the front end portion is defined by an end edge portion of the peripheral edge, the end edge portion having a substantially circular profile to cover a greater portion of a user's palm adjacent a wrist.

* * * * *